US010487556B2

(12) United States Patent
Hyun

(10) Patent No.: US 10,487,556 B2
(45) Date of Patent: Nov. 26, 2019

(54) HINGE ASSEMBLY FOR TRUNK LID

(71) Applicants: Hyundai Motor Company, Seoul (KR); Kia Motors Corporation, Seoul (KR)

(72) Inventor: Jang Hwan Hyun, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 15/980,510

(22) Filed: May 15, 2018

(65) Prior Publication Data

US 2019/0169905 A1 Jun. 6, 2019

(30) Foreign Application Priority Data

Dec. 6, 2017 (KR) ..... 10-2017-0166568

(51) Int. Cl.

| | |
|---|---|
| ***E05F 1/08*** | (2006.01) |
| ***E05F 5/02*** | (2006.01) |
| ***E05D 5/06*** | (2006.01) |
| *E05D 11/06* | (2006.01) |

(52) U.S. Cl.

CPC ..... *E05F 5/022* (2013.01); *E05D 5/062* (2013.01); *E05D 11/06* (2013.01); *E05D 2005/067* (2013.01); *E05Y 2900/548* (2013.01)

(58) Field of Classification Search

CPC ..... E05D 11/04; E05D 11/045; E05D 11/06; E05D 11/1085; E05D 11/1007; E05D 2205/067; E05D 5/062; E05D 3/127; E05D 3/145; E05D 3/18; E05D 3/12; E05Y 2900/502; E05Y 2900/50; E05Y 2900/548; E05Y 2900/536; E05Y 2900/546; E05Y 2900/531; E05Y 2201/416; E05F 1/123; E05F 1/1238; E05F 1/1033; E05F 1/1276; E05F 1/1284; E05F 5/022; Y10T 16/5402; Y10T 16/54024; Y10T 16/540247; Y10T 16/54026; Y10T 16/54048; Y10T 16/5409; Y10T 16/53885; Y10T 16/5389; Y10T 16/53834; Y10T 16/5385

See application file for complete search history.

(56) References Cited

U.S. PATENT DOCUMENTS 2,272,230 A * 2/1942 Van Voorhees ..... E05F 1/1207 16/306
2,947,025 A * 8/1960 Campbell ..... E05D 1/04 16/275

(Continued)

FOREIGN PATENT DOCUMENTS

CN 204590881 U 8/2015
CN 205012837 U 2/2016

(Continued)

*Primary Examiner* — Chuck Y Mah

(74) *Attorney, Agent, or Firm* — Mintz Levin Cohn Ferris Glovsky and Popeo, P.C.; Peter F. Corless

(57) ABSTRACT

A hinge assembly for a trunk lid, includes: a hinge bracket attached to a trunk compartment; a hinge arm attached to a trunk lid and pivotally connected to the hinge bracket; and a damping mechanism disposed between the hinge bracket and the hinge arm, and damping a pivoting movement of the hinge arm, where the hinge arm has a hollow portion in which the damping mechanism is received.

8 Claims, 14 Drawing Sheets

(56) References Cited

U.S. PATENT DOCUMENTS

| | | | | |
|---|---|---|---|---|
| 3,621,509 | A * | 11/1971 | Bugnell | E05D 5/062 16/289 |
| 6,269,521 | B1 * | 8/2001 | Gabel | E05D 3/145 16/287 |
| 6,401,299 | B1 * | 6/2002 | Schwarz | E05D 11/105 16/335 |
| 7,350,845 | B1 * | 4/2008 | Duffy | E05F 1/1215 16/296 |
| 8,882,173 | B2 * | 11/2014 | Thorpe | E05D 3/18 16/277 |
| 9,279,279 | B1 * | 3/2016 | Kim | E05F 1/1008 |
| 2005/0172453 | A1 * | 8/2005 | Duffy | E05D 5/062 16/307 |
| 2006/0230578 | A1 * | 10/2006 | Renke | E05D 5/062 16/289 |
| 2008/0018131 | A1 * | 1/2008 | Heath | E05D 5/062 296/76 |
| 2008/0098567 | A1 * | 5/2008 | Duffy | E05F 1/1016 16/306 |
| 2009/0194348 | A1 | 8/2009 | Faubert et al. | |
| 2009/0282648 | A1 | 11/2009 | Lee | |
| 2010/0275518 | A1 | 11/2010 | Nakazato | |
| 2013/0318745 | A1 * | 12/2013 | Krajenke | E05F 1/1284 16/305 |

FOREIGN PATENT DOCUMENTS

| | | | | |
|---|---|---|---|---|
| DE | 4125184 | A1 * | 2/1993 | B60J 3/0213 |
| JP | 2010-254215 | A | 11/2010 | |
| KR | 10-00962134 | | 11/2009 | |

* cited by examiner

HINGE ASSEMBLY FOR TRUNK LID

CROSS-REFERENCE TO RELATED APPLICATION

This application claims under 35 U.S.C. § 119(a) the benefit of Korean Patent Application No. 10-2017-0166568, filed on Dec. 6, 2017 in the Korean Intellectual Property Office, the entire contents of which are incorporated by reference herein.

BACKGROUND

(a) Technical Field

The present disclosure relates to a hinge assembly for a trunk lid, and more particularly, to a hinge assembly for a trunk lid capable of reducing manufacturing costs and smoothly opening and closing the trunk lid.

(b) Description of the Related Art

A vehicle is provided with a trunk compartment in which luggage is received, and the trunk compartment is opened and closed by a trunk lid.

The trunk lid may be configured to move between a closed position in which an opening of the trunk compartment is closed by a pair of hinge assemblies and an opened position in which the opening of the trunk compartment is opened by the pair of hinge assemblies.

The pair of hinge assemblies may be spaced apart from each other in a lateral direction of the trunk lid. Each hinge assembly includes a hinge bracket fixed to an inner panel of the trunk compartment, a hinge arm fixed to the trunk lid, and a gas lift and a coil spring connected to the hinge arm.

One end of the hinge arm may be connected to the hinge bracket through a hinge pin, and the other end of the hinge arm may be fixed to the trunk lid. The hinge arm and the trunk lid may pivot on the hinge pin. The gas lift may apply force to the hinge arm, and the trunk lid may quickly move to the opened position.

However, conventional hinge assemblies have used relatively expensive gas lifts and coil springs, thereby increasing manufacturing costs thereof.

In addition, the conventional hinge assemblies have disadvantages in that an opening velocity of the trunk lid may sharply increase while the trunk lid is moving to the fully opened position, and thus the trunk lid may severely vibrate and shake.

SUMMARY

An aspect of the present disclosure provides a hinge assembly for a trunk lid capable of reducing manufacturing costs, and reducing an opening velocity of the trunk lid to thereby prevent the occurrence of vibration and shaking in the trunk lid.

According to an aspect of the present disclosure, a hinge assembly for a trunk lid may include: a hinge bracket attached to a trunk compartment; a hinge arm attached to a trunk lid and pivotally connected to the hinge bracket; and a damping mechanism damping a pivoting movement of the hinge arm, wherein the hinge arm has a hollow portion in which the damping mechanism is received.

The hinge bracket may include a damping profile having a curved surface limiting a range of the pivoting movement of the hinge arm.

The damping mechanism may include a rolling pin in rolling contact with the damping profile.

The rolling pin may be movable in the hollow portion of the hinge arm.

The hinge arm may have a guide slot guiding movement of the rolling pin.

The damping mechanism may further include a pin holder supporting the rolling pin.

The damping mechanism may further include a damping spring elastically supporting the pin holder.

The damping mechanism may include a moving member having a contact portion in contact with the damping profile.

The moving member may be movable in the hollow portion of the hinge arm.

The hinge arm may have a guide slot guiding movement of the moving member.

The damping mechanism may further include a damping spring elastically supporting the moving member.

The damping mechanism may include a moving member movable in the hollow portion of the hinge arm, and a rolling pin rotatably mounted in the moving member, and the rolling pin may be in rolling contact with the damping profile.

The hinge arm may have a guide slot guiding movement of the moving member.

The damping mechanism may further include a damping spring elastically supporting the moving member.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
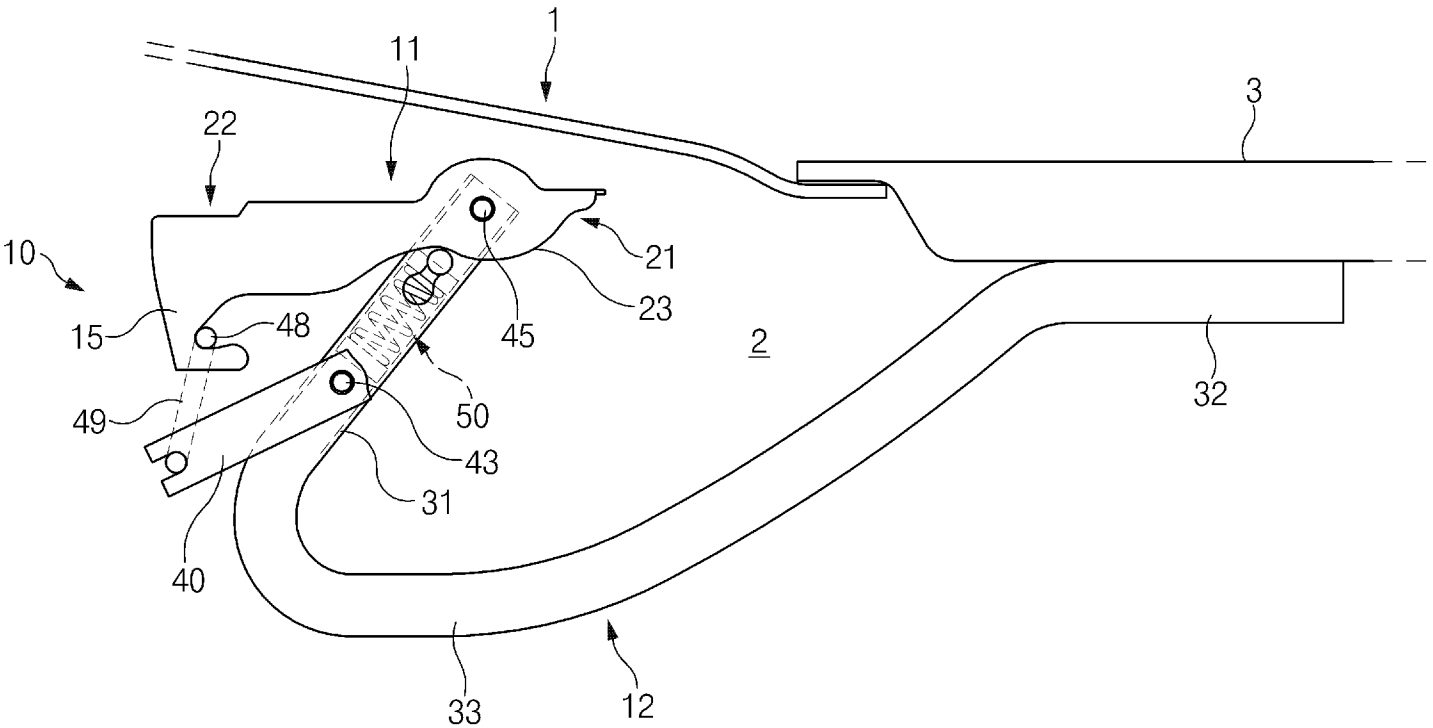
FIG. 1 is a side view of a hinge assembly for a trunk lid according to an exemplary embodiment of the present disclosure.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Hereinafter, exemplary embodiments of the present disclosure will be described in detail with reference to the accompanying drawings. In the drawings, the same reference numerals will be used throughout to designate the same or equivalent elements. In addition, a detailed description of well-known techniques associated with the present disclosure will be ruled out in order not to unnecessarily obscure the gist of the present disclosure.

Terms such as first, second, A, B, (a), and (b) may be used to describe the elements in exemplary embodiments of the present disclosure. These terms are only used to distinguish one element from another element, and the intrinsic features, sequence or order, and the like of the corresponding elements are not limited by the terms. Unless otherwise defined, all terms used herein, including technical or scientific terms, have the same meanings as those generally understood by those with ordinary knowledge in the field of art to which the present disclosure belongs. Such terms as those defined in a generally used dictionary are to be interpreted as having meanings equal to the contextual meanings in the relevant field of art, and are not to be interpreted as having ideal or excessively formal meanings unless clearly defined as having such in the present application.

Referring to FIG. 1, a hinge assembly 10 for a trunk lid, according to an exemplary embodiment of the present disclosure, may include a hinge bracket 11 attached to an inner panel of a trunk compartment 2 of a vehicle body 1, and a hinge arm 12 pivotally connected to the hinge bracket 11.

The hinge bracket 11 may have a bracket body 13, and a pair of sidewalls 15 extended from the bracket body 13.

Figure 2:
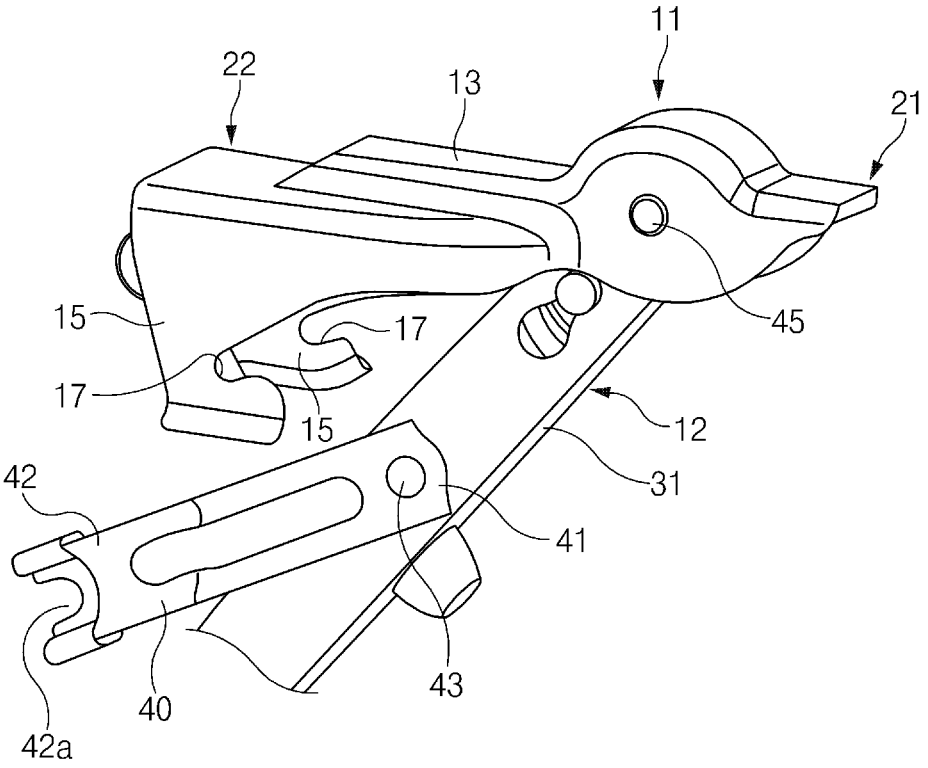
FIG. 2 is a perspective view of a hinge assembly for a trunk lid according to an exemplary embodiment of the present disclosure.
Figure 3:
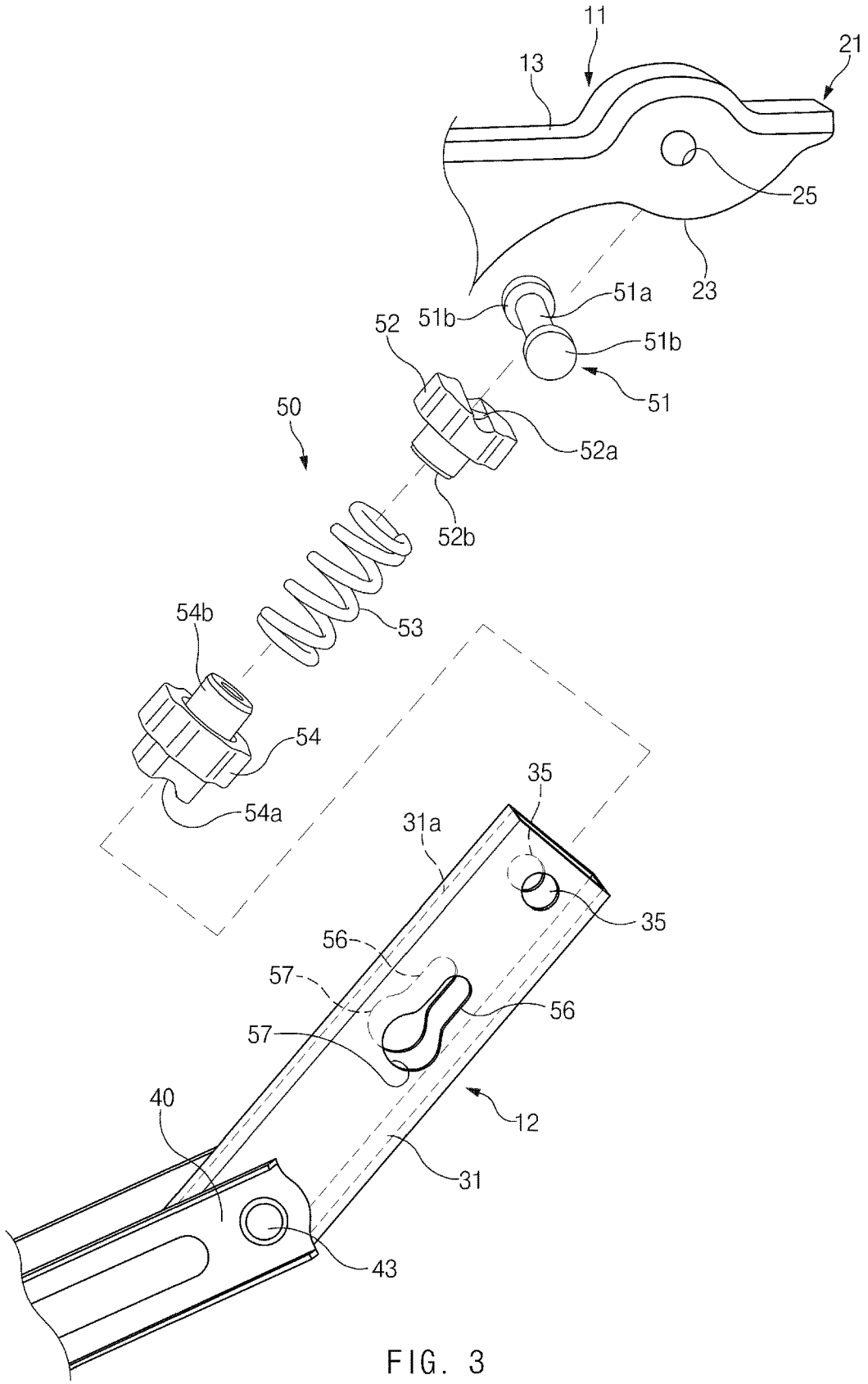
FIG. 3 is an exploded perspective view of a hinge assembly for a trunk lid according to an exemplary embodiment of the present disclosure.

As illustrated in FIGS. 2 and 3, the bracket body 13 may have a first end portion 21, and the first end portion 21 may have a hinge hole 25 into which the hinge pin 45 is inserted. The first end portion 21 may have a damping profile 23 formed on the bottom surface thereof, and the damping profile 23 may have a predetermined curved surface to limit a range of pivoting movement of the hinge arm 12.

The bracket body 13 may have a second end portion 22, and the pair of sidewalls 15 may be extended from both sides of the second end portion 22. The pair of sidewalls 15 may be spaced apart from each other. A slit 17 may be formed at the bottom end of each sidewall 15.

When a trunk lid 3 moves between a fully opened position and a fully closed position, the hinge arm 12 may pivot on the hinge pin 45.

The hinge arm 12 may have a first end portion 31 pivotally connected to the hinge bracket 11 by the hinge pin 45. The first end portion 31 may have a pair of hinge holes 35 aligned with the hinge hole 25 of the bracket body 13, and the hinge pin 45 may be inserted into the hinge hole 25 of the bracket body 13 and the hinge holes 35 of the hinge bracket 11 such that the first end portion 31 of the hinge arm 12 may be pivotally connected to the bracket body 13 of the hinge bracket 11. The first end portion 31 of the hinge arm 12 may have a hollow portion 31*a* in which a damping mechanism 50 is received.

The hinge arm 12 may have a second end portion 32 fixed to the trunk lid 3 by using fasteners, welding, or the like. In addition, the hinge arm 12 may have a curved intermediate portion 33 between the first end portion 31 and the second end portion 32.

The hinge assembly 10, according to an exemplary embodiment of the present disclosure, may include the damping mechanism 50 damping the pivoting movement of the hinge arm 12 to reduce an opening velocity of the trunk lid 3, and the damping mechanism 50 may be disposed between the hinge bracket 11 and the hinge arm 12.

A hinge link 40 may be connected between the first end portion 31 of the hinge arm 12 and the hinge bracket 11. The hinge link 40 may have a first end portion 41 pivotally connected to the first end portion 31 of the hinge arm 12, and a second end portion 42 connected to the hinge bracket 11.

The first end portion 41 may be pivotally connected to the first end portion 31 of the hinge arm 12 through a pivot pin (not shown). The second end portion 42 may have a groove 42*a*.

A pair of hinge assemblies 10 may be disposed between the trunk lid 3 and the trunk compartment 2, and the pair of hinge assemblies 10 may be spaced apart from each other in a lateral direction of the trunk lid 3. At least one torsion bar 48 may be connected between the pair of hinge assemblies 10, and each end portion of the torsion bar 48 may be bent to form a crank portion 49. The crank portion 49 of the torsion bar 48 may be mounted between the slit 17 of the hinge bracket 11 and the groove 42*a* of the hinge link 40 such that the second end portion 42 of the hinge link 40 may be connected to the hinge bracket 11.

When the trunk lid 3 moves to the closed position to close the trunk compartment 2, the crank portion 49 may be twisted. When the trunk lid 3 moves to the opened position to open the trunk compartment 2, the trunk lid 3 may receive elastic force in an opening direction due to torsional elasticity of the crank portion 49 such that the trunk lid 3 may be maintained in the open state.

As illustrated in FIGS. 1 to 10, the damping mechanism 50 may be mounted in the hollow portion 31*a* of the first end portion 31 of the hinge arm 12.

The damping mechanism 50, according to an exemplary embodiment, may include, as illustrated in FIGS. 2 and 3, a rolling pin 51 movable in the hollow portion 31*a* of the hinge arm 12, a pin holder 52 supporting the rolling pin 51, and a damping spring 53 elastically supporting the pin holder 52.

The rolling pin 51 may have a shaft 51*a*, and a pair of heads 51*b* formed on both ends of the shaft 51*a* to face each other.

The first end portion 31 of the hinge arm 12 may have a pair of guide slots 56 formed in the sides thereof, and the shaft 51*a* of the rolling pin 51 may be inserted across the pair of guide slots 56 such that the shaft 51*a* of the rolling pin 51 may be guided along the pair of guide slots 56.

The heads 51*b* of the rolling pin 51 may protrude out of the guide slots 56, respectively. The heads 51*b* of the rolling pin 51 may be in rolling contact with the damping profile 23 of the hinge bracket 11.

An insertion hole 57 may be formed in one end of the guide slot 56, and the insertion hole 57 may have a larger diameter than a width of the guide slot 56. The insertion hole 57 may have an inner diameter corresponding to a diameter of the head 51*b* of the rolling pin 51.

The pin holder 52 may have a support groove 52*a* in the top surface thereof, and the shaft 51*a* of the rolling pin 51 may be rotatably supported by the support groove 52*a* of the pin holder 52. The pin holder 52 may have a protrusion 52*b* extended from the bottom surface thereof.

The damping spring 53 may be disposed below the pin holder 52 to elastically support the pin holder 52. A spring holder 54 may be disposed below the damping spring 53.

The spring holder 54 may have a protrusion 54*b* extended from the top surface thereof, and a groove 54*a* formed in the bottom surface thereof. The groove 54*a* of the spring holder 54 may be supported by a pivot pin 43 of the hinge link 40. The top end of the damping spring 53 may be supported by the pin holder 52, and the bottom end of the damping spring 53 may be supported by the spring holder 54. The top end of the damping spring 53 may be guided by the protrusion 52*b* of the pin holder 52, and the bottom end of the damping spring 53 may be guided by the protrusion 54*b* of the spring holder 54.

When the hinge arm 12 is pivoted by the opening and closing of the trunk lid 3, the heads 51*b* of the rolling pin 51 may move along the curved surface of the damping profile 23 of the hinge bracket 11, and the shaft 51*a* of the rolling pin 51 may be guided along the pair of guide slots 56. Thus, the rolling pin 51 may move along an axis X1 of the first end portion 31 of the hinge arm 12 (see FIGS. 8 to 10), and the movement of the rolling pin 51 may be damped by the damping spring 53. Therefore, the pivoting movement of the hinge arm 12 may be damped by the damping mechanism 50.

FIGS. 4 to 7 illustrate a process of assembling the damping mechanism 50 in the hollow portion 31*a* of the first end portion 31 of the hinge arm 12.

Figure 4:
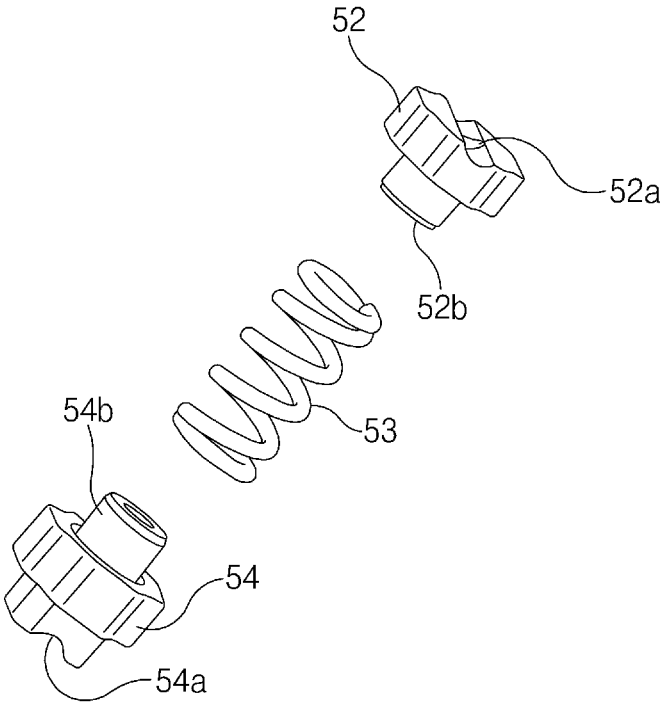
FIG. 4 is an exploded perspective view of a pin holder, a damping spring, and a spring holder of a hinge assembly for a trunk lid according to an exemplary embodiment of the present disclosure.
Figure 5:
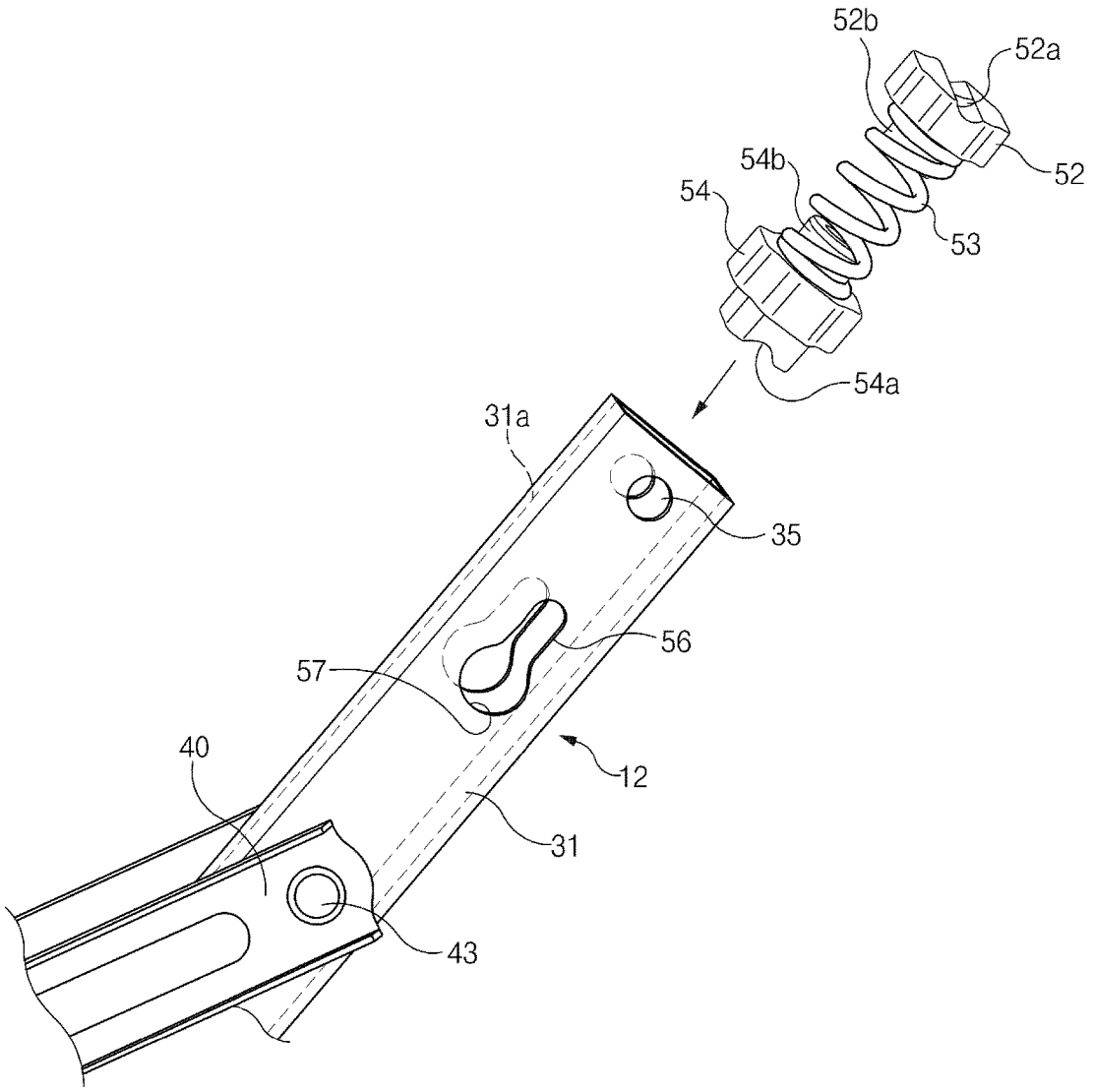
FIG. 5 is an exploded perspective view of a hinge arm, a pin holder, a damping spring, and a spring holder of a hinge assembly for a trunk lid according to an exemplary embodiment of the present disclosure.

After the damping spring 53 is interposed between the pin holder 52 and the spring holder 54 as illustrated in FIG. 4, the pin holder 52, the damping spring 53, and the spring holder 54 may be inserted into the hollow portion 31*a* of the first end portion 31 of the hinge arm 12 as illustrated in FIG. 5.

Figure 6:
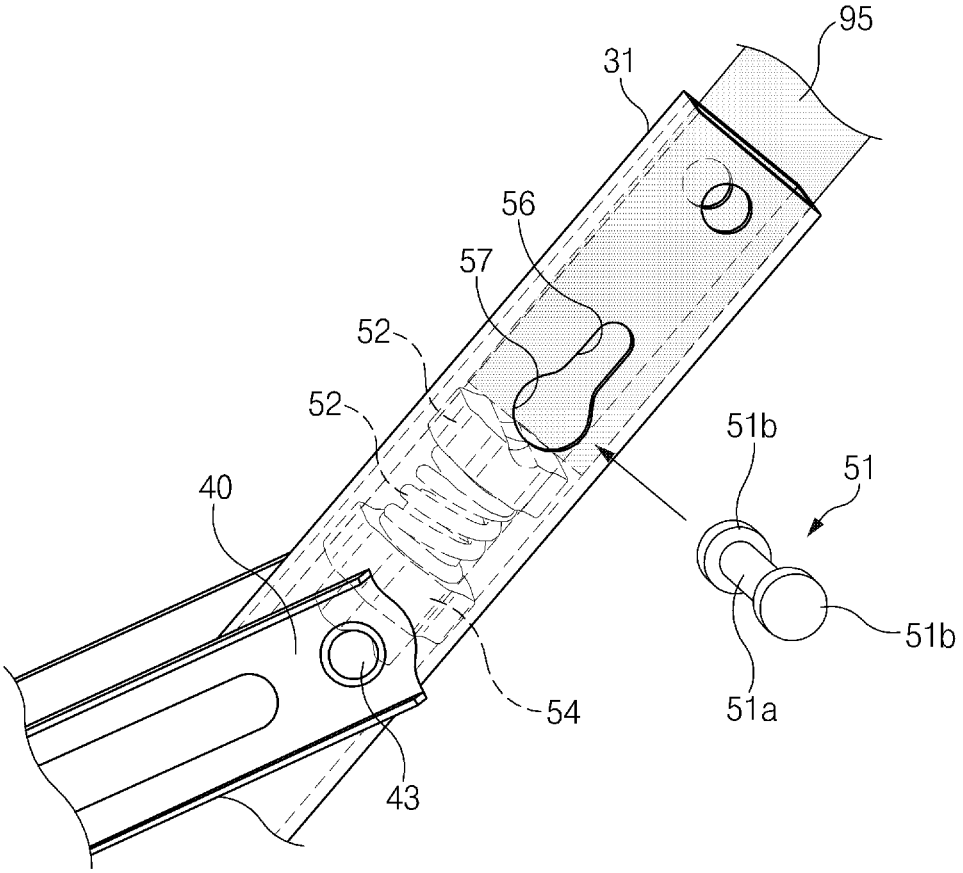
FIG. 6 is an exploded perspective view of a rolling pin in a state in which a pin holder, a damping spring, and a spring holder are inserted into a hinge arm of a hinge assembly for a trunk lid according to an exemplary embodiment of the present disclosure.
Figure 7:
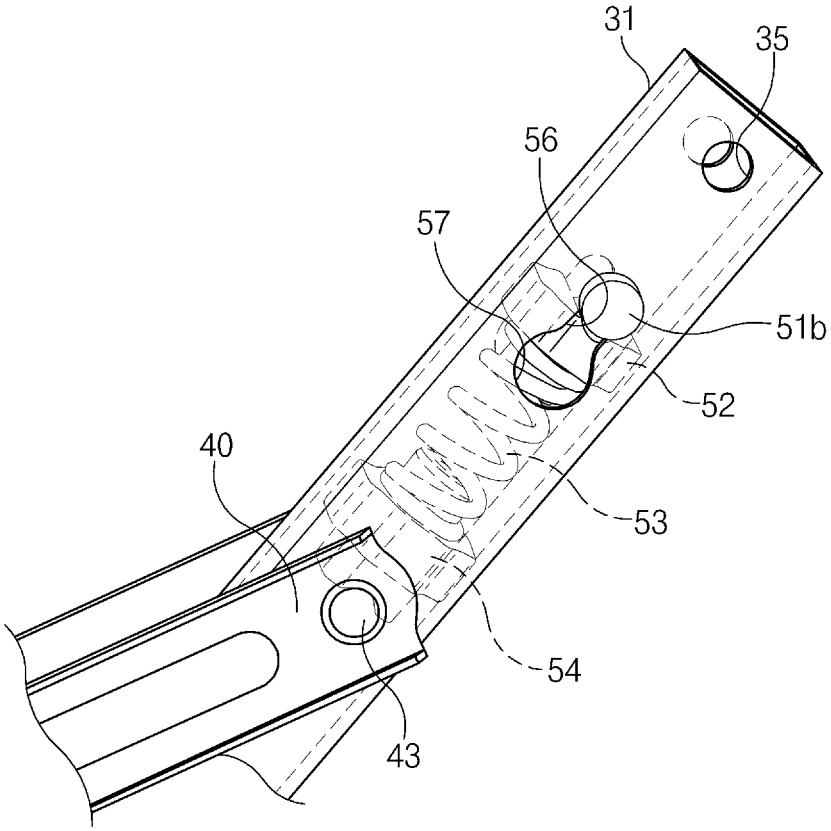
FIG. 7 is a perspective view of a state in which a pin holder, a damping spring, and a spring holder are mounted in a hinge arm of a hinge assembly for a trunk lid according to an exemplary embodiment of the present disclosure.

Thereafter, as illustrated in FIG. 6, the damping spring 53 may be compressed by a spring compression jig 95 such that the support groove 52*a* of the pin holder 52 and the insertion hole 57 of the hinge arm 12 may be aligned. Then, the heads 51*b* of the rolling pin 51 may be inserted into the insertion holes 57 such that the rolling pin 51 may be seated in the support groove 52*a* of the pin holder 52 as illustrated in FIG. 7, and thus the damping mechanism 50 may be assembled into the first end portion 31 of the hinge arm 12.

Figure 8:
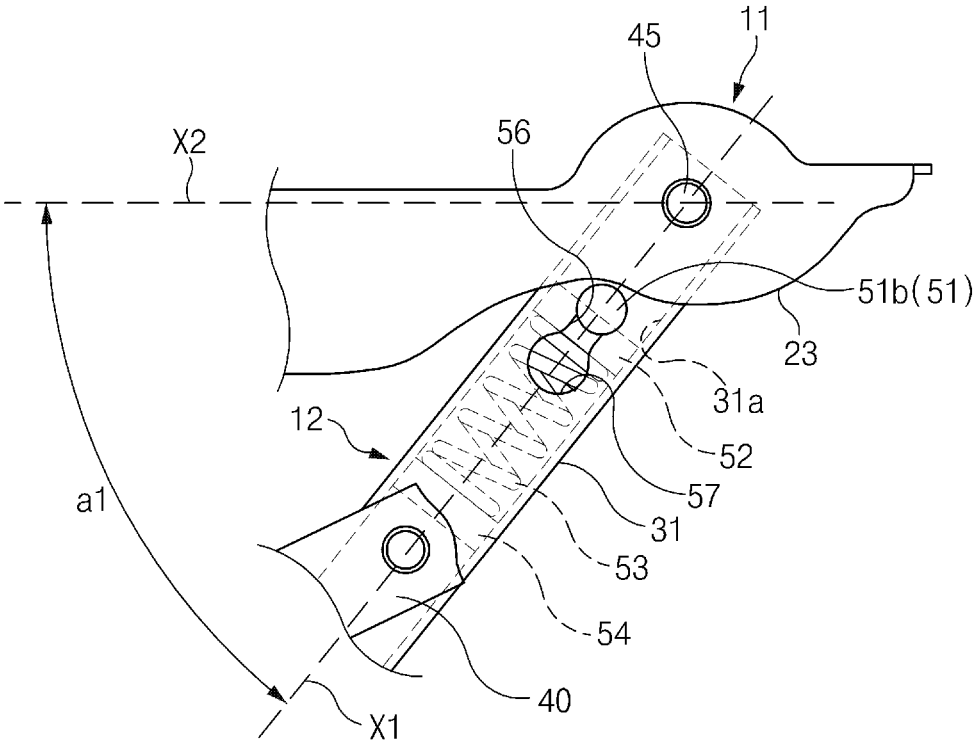
FIG. 8 illustrates a position of a hinge arm when a trunk lid is positioned in a fully closed position.
Figure 9:
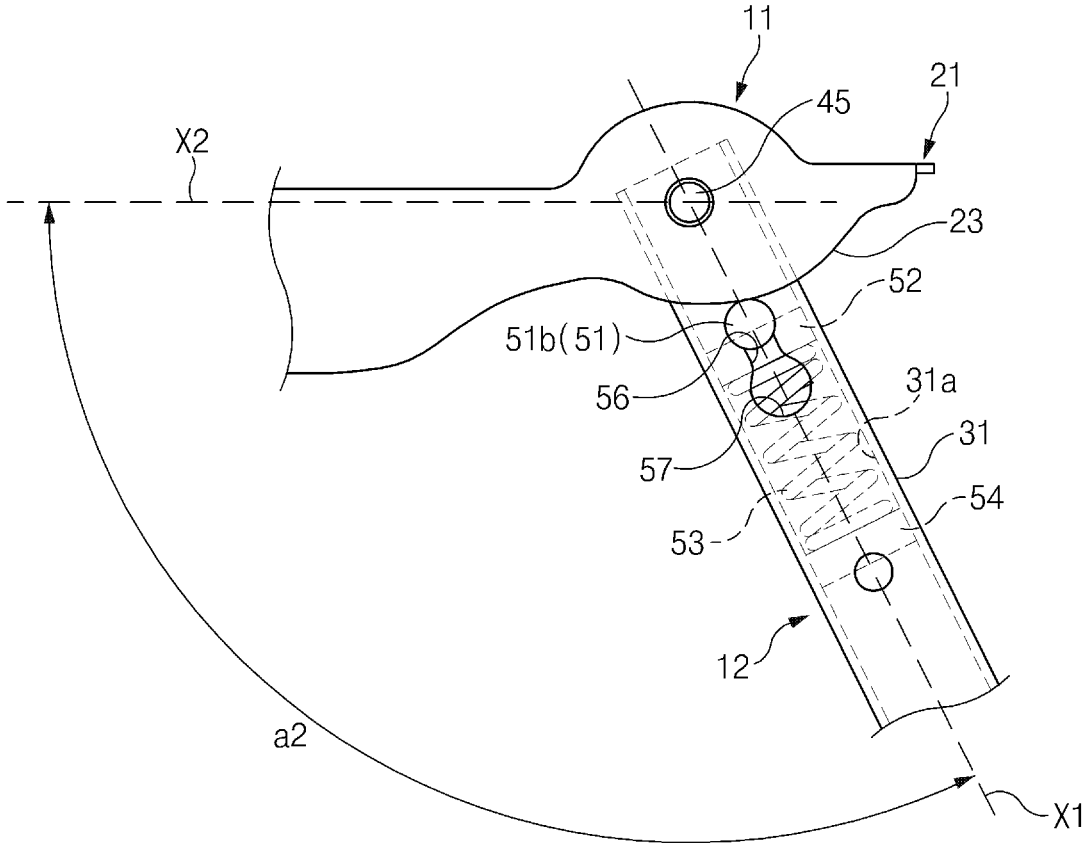
FIG. 9 illustrates a position of a hinge arm when a trunk lid is positioned in a partially opened position.

FIGS. 8 to 9 illustrate an operation of the damping mechanism 50 when the trunk lid 3 is opened.

FIG. 8 illustrates a position of the hinge arm 12 when the trunk lid 3 closes the trunk compartment 2 in a fully closed position. As illustrated in FIG. 8, the axis X1 of the first end portion 31 of the hinge arm 12 may intersect with an axis X2 of the bracket body 13 of the hinge bracket 11 at a first angle a1, and the heads 51*b* of the rolling pin 51 may not contact the damping profile 23, and thus the damping spring 53 may be relaxed. For example, the first angle a1 may be approximately 40°.

FIG. 9 illustrates a position of the hinge arm 12 when the trunk lid 3 partially opens the trunk compartment 2 in a partially opened position. As illustrated in FIG. 9, the axis X1 of the first end portion 31 of the hinge arm 12 may intersect with the axis X2 of the bracket body 13 of the hinge bracket 11 at a second angle a2, and the heads 51*b* of the rolling pin 51 may start to contact an intermediate point of the damping profile 23, and thus the damping spring 53 may start to be compressed. For example, the second angle a2 may be approximately 59°.

Figure 10:
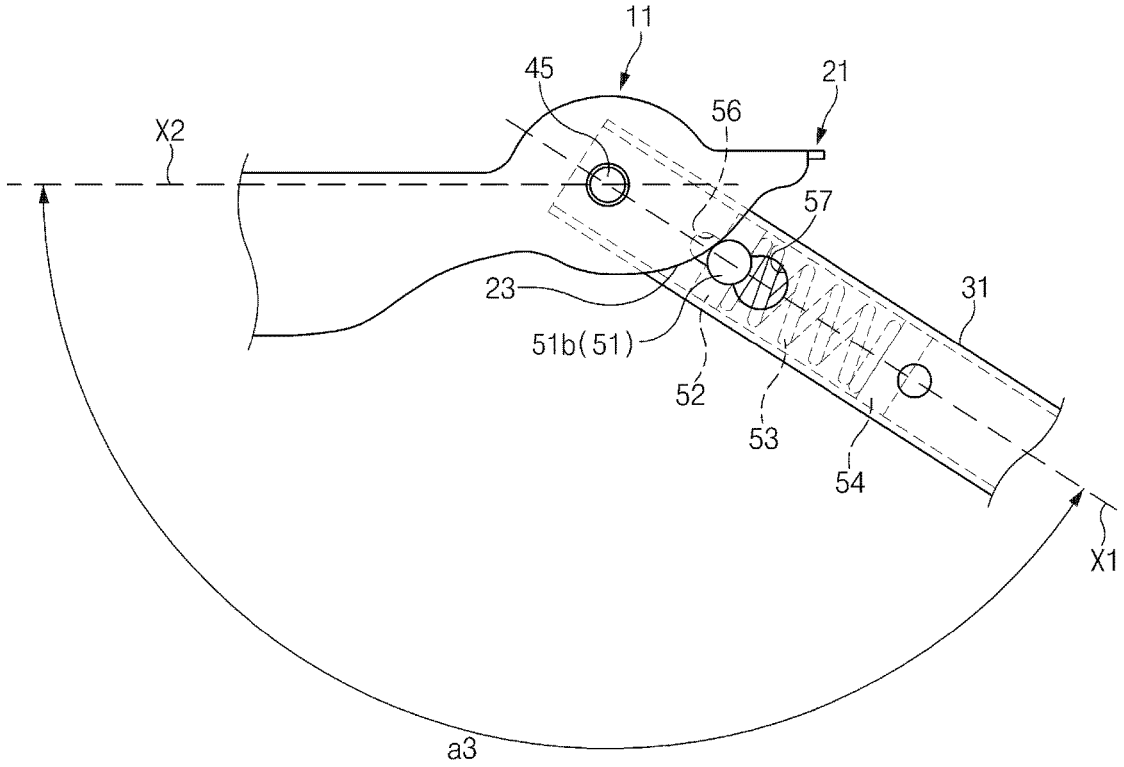
FIG. 10 illustrates a position of a hinge arm when a trunk lid is positioned in a fully opened position.

FIG. 10 illustrates a position of the hinge arm 12 when the trunk lid 3 fully opens the trunk compartment 2 in a fully opened position. As illustrated in FIG. 10, the axis X1 of the first end portion 31 of the hinge arm 12 may intersect with the axis X2 of the bracket body 13 of the hinge bracket 11 at a third angle a3, and the heads 51*b* of the rolling pin 51 may contact an end point of the damping profile 23, and thus the damping spring 53 may be fully compressed. For example, the third angle a3 may be approximately 130°.

When the trunk lid 3 moves from the fully closed position to the fully opened position, the damping mechanism 50 may damp the pivoting movement of the hinge arm 12 such that the opening velocity of the trunk lid 3 may be reduced.

Figure 11:
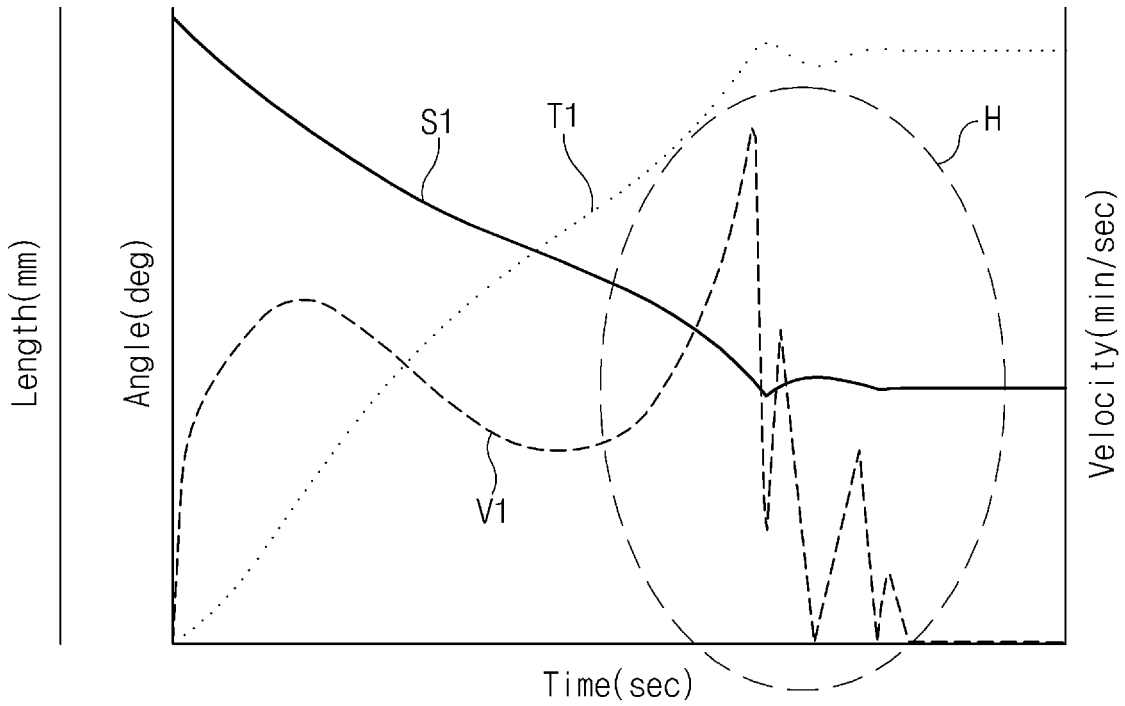
FIG. 11 is a graph of an opening velocity of a trunk lid, a torque of the trunk lid, and a deformation of a torsion bar when the trunk lid is opened, according to the related art.

FIG. 11 is a graph of an opening velocity V1 of the trunk lid 3, a torque T1 of the trunk lid 3, and a deformation S1 of the torsion bar 48 when the trunk lid 3 is opened, according to the related art. It can be seen in area H of FIG. 11 that when the trunk lid 3 approaches the fully opened position and the opening velocity V1 of the trunk lid 3 sharply increases, the opening velocity V1 of the trunk lid 3 may significantly change so that the trunk lid 3 severely vibrates and shakes.

Figure 12:
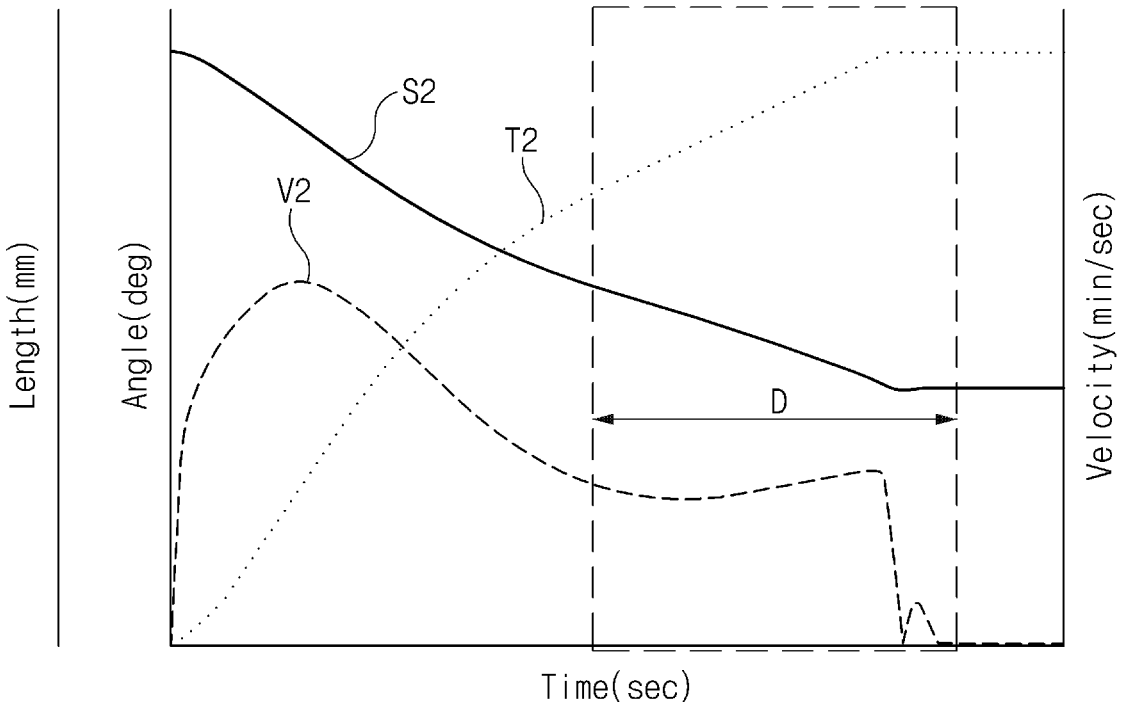
FIG. 12 is a graph of an opening velocity of a trunk lid, a torque of the trunk lid, and a deformation of a torsion bar when the trunk lid is opened, according to an exemplary embodiment of the present disclosure.

FIG. 12 is a graph of an opening velocity V2 of the trunk lid 3, a torque T2 of the trunk lid 3, and a deformation S2 of the torsion bar 48 when the trunk lid 3 is opened, according to an exemplary embodiment of the present disclosure. It can be seen in area D of FIG. 12 that when the trunk lid 3 approaches the fully opened position, the opening velocity V2 of the trunk lid 3 may be reduced so that no vibration and shaking occurs in the trunk lid 3.

Figure 13:
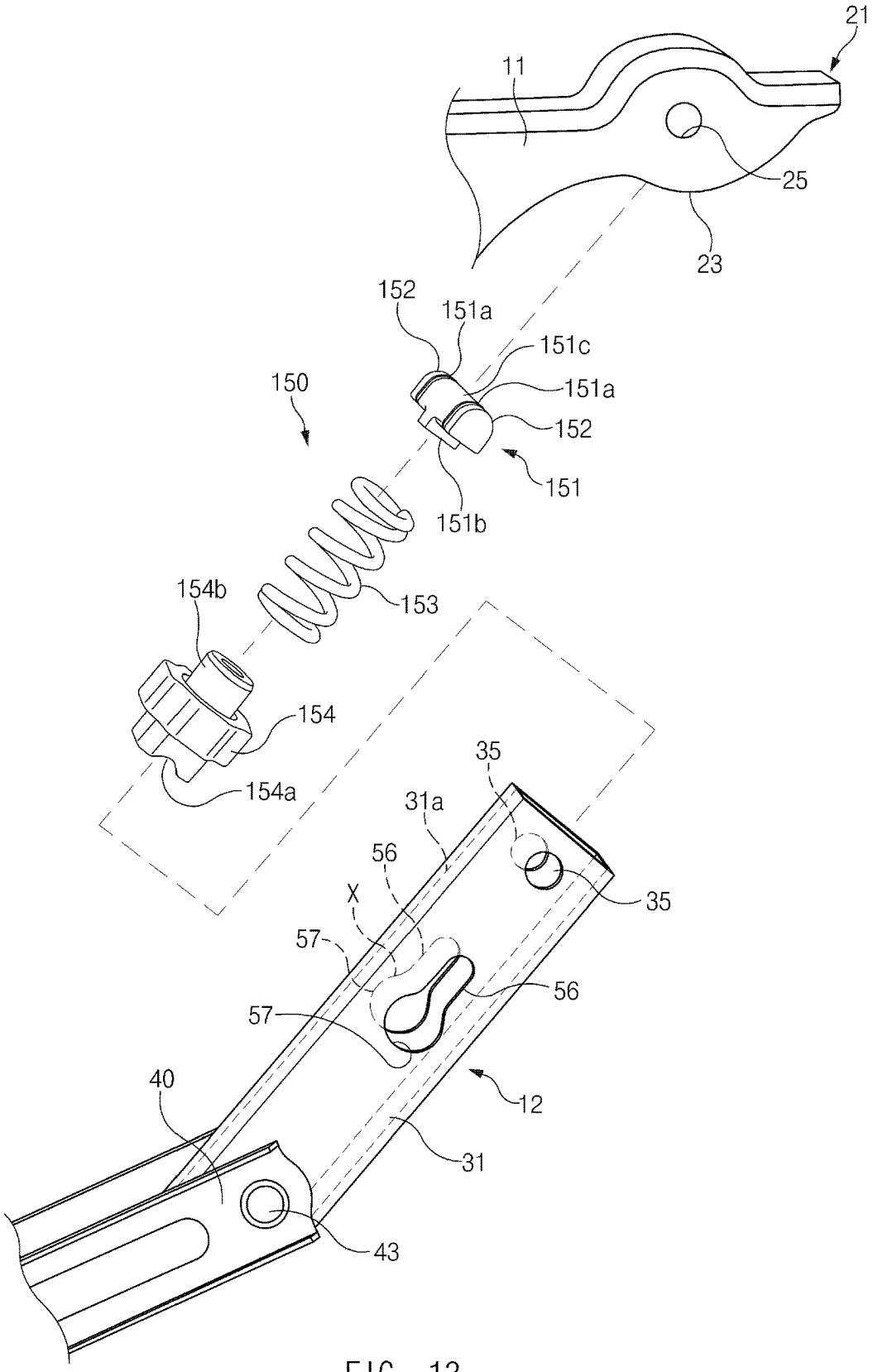
FIG. 13 is an exploded perspective view of a damping mechanism according to another exemplary embodiment of the present disclosure.

FIG. 13 illustrates a damping mechanism 150 according to another exemplary embodiment of the present disclosure.

The damping mechanism 150 according to the exemplary embodiment illustrated in FIG. 13 may include a moving member 151 movable in the hollow portion 31*a* of the hinge arm 12, and a damping spring 153 elastically supporting the moving member 151.

The moving member 151 may have a pair of grooves 151*a* and a pair of contact portions 152. The pair of grooves 151*a* may be formed in both sides of an intermediate portion 151*c* of the moving member 151 to be spaced apart from each other, and the contact portions 152 may be continuously disposed in the grooves 151*a*, respectively. The intermediate portion 151*c* of the moving member 151 may be inserted into the hollow portion 31*a* of the hinge arm 12.

The first end portion 31 of the hinge arm 12 may have the pair of guide slots 56 formed in both sides thereof. The grooves 151*a* of the moving member 151 may be disposed in the guide slots 56 of the hinge arm 12, respectively, and the intermediate portion 151*c* of the moving member 151 may be disposed across the pair of guide slots 56 such that the moving member 151 may be guided along the pair of guide slots 56.

The pair of contact portions 152 may protrude out of both sides of the hinge arm 12, and the contact portions 152 may contact the damping profile 23 of the hinge bracket 11. Each contact portion 152 may have a curved top surface so that it may stably slide along the damping profile 23. The moving member 151 may have a protrusion 151*b* extended from the bottom surface thereof.

The insertion hole 57 may be formed in one end of each guide slot 56, and the diameter of the insertion hole 57 may be larger than the width of the guide slot 56. The insertion hole 57 may have the inner diameter allowing the moving member 151 to be inserted.

The damping spring 153 may be disposed below the moving member 151 to elastically support the moving member 151. A spring holder 154 may be disposed below the damping spring 153.

The spring holder 154 may have a protrusion 154*b* extended from the top surface thereof, and a groove 154*a* formed in the bottom surface thereof. The groove 154*a* of the spring holder 154 may be supported by the pivot pin 43 of the hinge link 40. The top end of the damping spring 153 may be supported by the moving member 151, and the bottom end of the damping spring 153 may be supported by the spring holder 154. The top end of the damping spring 153 may be guided by the protrusion 151*b* of the moving member 151, and the bottom end of the damping spring 153 may be guided by the protrusion 154*b* of the spring holder 154.

When the hinge arm 12 is pivoted by the opening and closing of the trunk lid 3, the contact portions 152 of the moving member 151 may move along the curved surface of the damping profile 23 of the hinge bracket 11, and the grooves 151*b* of the moving member 151 may be guided along the pair of guide slots 56. The moving member 151 may move along the axis X1 of the first end portion 31 of the hinge arm 12, and the movement of the moving member 151 may damped by the damping spring 153. Thus, the pivoting movement of the hinge arm 12 may be damped by the damping mechanism 150.

Figure 14:
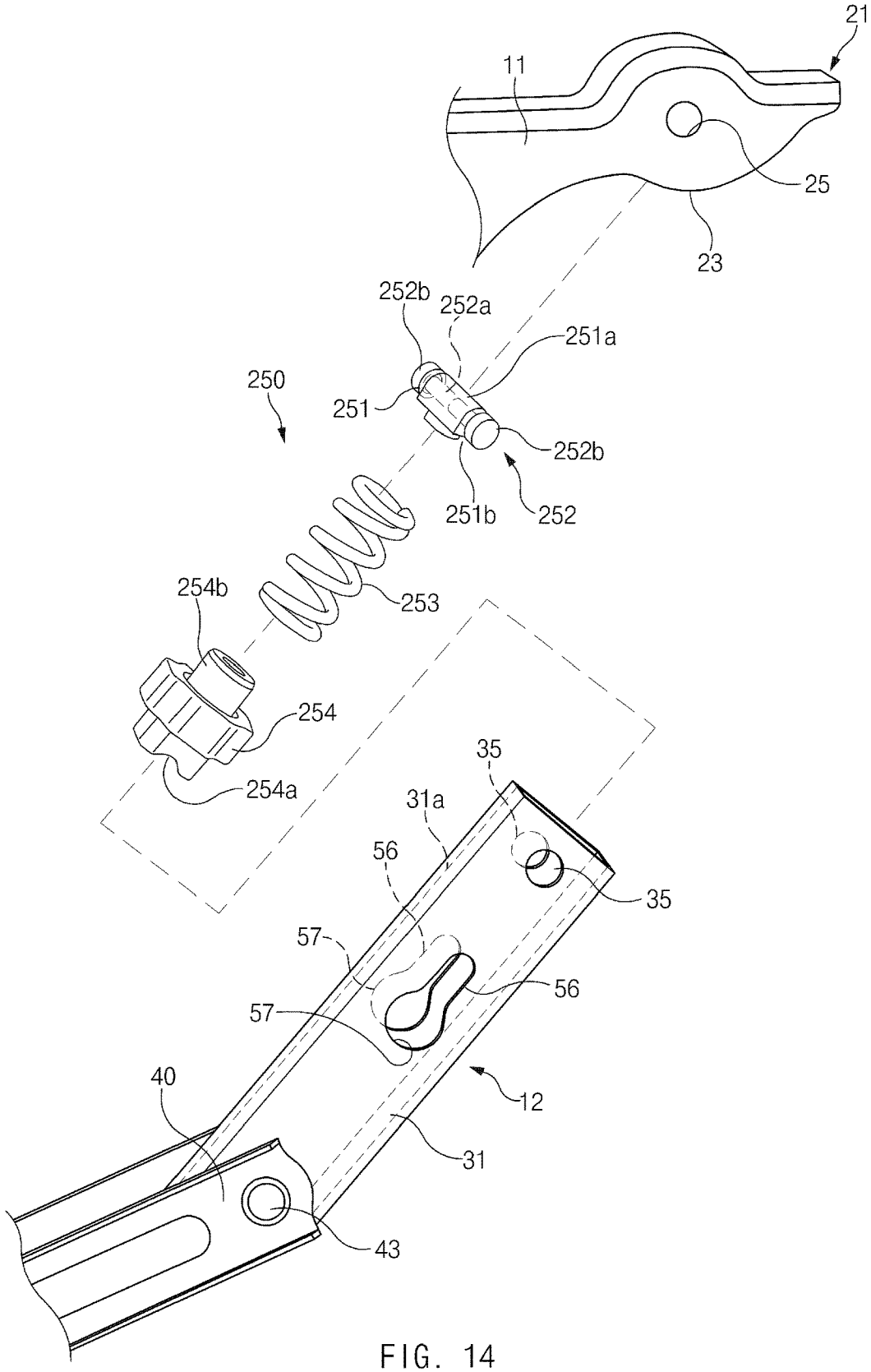
FIG. 14 is an exploded perspective view of a damping mechanism according to another exemplary embodiment of the present disclosure.

FIG. 14 illustrates a damping mechanism 250 according to another exemplary embodiment of the present disclosure.

The damping mechanism 250 according to the exemplary embodiment illustrated in FIG. 14 may include a moving member 251 movable in the hollow portion 31*a* of the hinge arm 12, a rolling pin 252 rotatably mounted in the moving member 251, and a damping spring 253 elastically supporting the moving member 251.

The moving member 251 may have a curved top surface 251*a* and a protrusion 251*b* extended from the bottom surface thereof.

The rolling pin 252 may have a shaft 252*a*, and a pair of heads 252*b* formed on both ends of the shaft 252*a* to face each other. The shaft 252*a* may be rotatably mounted in the moving member 251.

The first end portion 31 of the hinge arm 12 may have the pair of guide slots 56 formed in both sides thereof. A predetermined gap may be formed between the heads 252*b* of the rolling pin 252 and the side surfaces of the moving member 251, respectively, and the shaft 252*a* of the rolling pin 252 may be disposed across the pair of guide slots 56. The heads 252*b* of the rolling pin 252 may protrude out of the guide slots 56, respectively. The heads 252*b* of the rolling pin 252 may be in rolling contact with the damping profile 23 of the hinge bracket 11.

The insertion hole 57 may be formed in one end of the guide slot 56, and the diameter of the insertion hole 57 may be larger than the width of the guide slot 56. The insertion hole 57 may have the inner diameter allowing the moving member 251 to be inserted.

The damping spring 253 may be disposed below the moving member 251 to elastically support the moving member 251. A spring holder 254 may be disposed below the damping spring 253.

The spring holder 254 may have a protrusion 254*b* extended from the top surface thereof, and a groove 254*a* formed in the bottom surface thereof. The groove 254*a* of the spring holder 254 may be supported by the pivot pin 43 of the hinge link 40. The top end of the damping spring 253 may be supported by the moving member 251, and the bottom end of the damping spring 253 may be supported by the spring holder 254. The top end of the damping spring 253 may be guided by the protrusion 251*b* of the moving member 251, and the bottom end of the damping spring 253 may be guided by the protrusion 254*b* of the spring holder 254.

When the hinge arm 12 is pivoted by the opening and closing of the trunk lid 3, the heads 252*b* of the rolling pin 252 may move along the curved surface of the damping profile 23 of the hinge bracket 11, and the moving member 251 may be guided along the pair of guide slots 56. The moving member 251 may move along the axis X1 of the first end portion 31 of the hinge arm 12, and the movement of the moving member 251 may be damped by the damping spring 253. Thus, the pivoting movement of the hinge arm 12 may be damped by the damping mechanism 250.

As set forth above, the hinge assembly for a trunk lid, according to exemplary embodiments of the present disclosure, may reduce manufacturing costs, and reduce the opening velocity of the trunk lid to thereby prevent the occurrence of vibration and shaking in the trunk lid.

In addition, according to exemplary embodiments of the present disclosure, the damping mechanism may be configured to damp the pivoting movement of the hinge arm in the hollow portion of the hinge arm so that the surrounding space of the hinge bracket and the hinge arm may be simplified.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. A hinge assembly for a trunk lid, comprising:

a hinge bracket attached to a trunk compartment;

a hinge arm attached to a trunk lid and pivotally connected to the hinge bracket; and a damping mechanism damping a pivoting movement of the hinge arm, wherein the hinge arm has a hollow portion in which the damping mechanism is received, wherein the hinge bracket includes a damping profile having a curved surface limiting a range of the pivoting movement of the hinge arm, and wherein the damping mechanism includes a rolling pin in rolling contact with the damping profile, a pin holder supporting the rolling pin, and a damping spring elastically supporting the pin holder.

2. The hinge assembly according to claim 1, wherein the rolling pin is movable in the hollow portion of the hinge arm.

3. The hinge assembly according to claim 2, wherein the hinge arm has a guide slot guiding movement of the rolling pin.

4. The hinge assembly according to claim 1, wherein the damping mechanism further includes a moving member movable in the hollow portion of the hinge arm, wherein the rolling pin is rotatably mounted in the moving member.

5. The hinge assembly according to claim 4, wherein the hinge arm has a guide slot guiding movement of the moving member.

6. The hinge assembly according to claim 4, wherein the damping mechanism further includes a damping spring elastically supporting the moving member.

7. A hinge assembly for a trunk lid, comprising:

a hinge bracket attached to a trunk compartment;

a hinge arm attached to a trunk lid and pivotally connected to the hinge bracket; and a damping mechanism damping a pivoting movement of the hinge arm, wherein the hinge arm has a hollow portion in which the damping mechanism is received, wherein the hinge bracket includes a damping profile having a curved surface limiting a range of the pivoting movement of the hinge arm, wherein the damping mechanism includes a moving member having a contact portion in contact with the damping profile and a damping spring elastically supporting the moving member, and wherein the hinge arm has a guide slot guiding movement of the moving member.

8. The hinge assembly according to claim 7, wherein the moving member is movable in the hollow portion of the hinge arm.

* * * * *